US010632639B2

(12) United States Patent
Fant

(10) Patent No.: US 10,632,639 B2
(45) Date of Patent: Apr. 28, 2020

(54) MACHINES AND METHODS FOR CUTTING PRODUCTS

(71) Applicant: Urschel Laboratories, Inc., Chesterton, IN (US)

(72) Inventor: James A. Fant, Chesterton, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 15/180,217

(22) Filed: Jun. 13, 2016

(65) Prior Publication Data

US 2016/0361831 A1 Dec. 15, 2016

Related U.S. Application Data

(60) Provisional application No. 62/174,985, filed on Jun. 12, 2015.

(51) Int. Cl.
*B26D 7/06* (2006.01)
*B26D 3/28* (2006.01)
(Continued)

(52) U.S. Cl.
CPC ..... *B26D 7/0691* (2013.01); *B26D 1/03* (2013.01); *B26D 3/28* (2013.01); *B26D 7/2614* (2013.01);
(Continued)

(58) Field of Classification Search
CPC ..... B26D 7/0691; B26D 7/2614; B26D 2210/02; B26D 1/03
(Continued)

(56) References Cited

U.S. PATENT DOCUMENTS 1,483,803 A * 2/1924 Hartburg ..... C13B 5/06 83/403
2,195,879 A * 4/1940 Urschel ..... B26D 1/03 83/403
(Continued)

FOREIGN PATENT DOCUMENTS

WO 2014-048582 4/2014

OTHER PUBLICATIONS

"Urschel (R) Model CC"., Jan. 31, 2018, 2-pages, Retrieve from the Internet: URL:https://www.urschel.com/sites/urschel.com/files/specs-model-cc.pdf., [retrieved on Jan. 15, 2019].
(Continued)

*Primary Examiner* — Ghassem Alie
*Assistant Examiner* — Bharat C Patel
(74) *Attorney, Agent, or Firm* — Hartman Global IP Law; Gary M. Hartman; Domenica N. S. Hartman

(57) ABSTRACT

Machines and methods for cutting products. Such a machine includes an annular-shaped cutting head and at least one knife that is oriented axially at an inner circumference of the cutting head and extends radially inward into an interior of the cutting head. An impeller is coaxially mounted within the cutting head and has a base, a ring spaced axially from the base, an entrance to an interior of the impeller defined by the ring, and a unit for delivering products within the interior of the impeller toward the inner circumference of the cutting head as the impeller rotates within the cutting head. The delivering unit includes paddles that are circumferentially spaced within the interior of the impeller between the base and the ring. The outer circumference of the impeller has a diameter of greater than 35 centimeters.

11 Claims, 4 Drawing Sheets

(51) Int. Cl.
*B26D 1/03* (2006.01)
*B26D 7/26* (2006.01)
*B26D 1/00* (2006.01)

(52) U.S. Cl.
CPC .... *B26D 2001/006* (2013.01); *B26D 2210/02* (2013.01)

(58) Field of Classification Search
USPC ..... 83/471.3, 403, 404.3, 419, 698.41, 410, 83/592, 703
See application file for complete search history.

(56) References Cited

U.S. PATENT DOCUMENTS 2,832,387 A * 4/1958 Woodward, Jr. ..... B26D 3/18 83/403
3,191,650 A * 6/1965 Lichko ..... C13B 5/06 241/259
3,857,310 A * 12/1974 Tiby ..... B26D 1/25 209/638
4,106,707 A * 8/1978 Kemnitz ..... B02C 2/007 241/202
4,326,676 A * 4/1982 Rose ..... B02C 13/1814 241/275
4,391,172 A * 7/1983 Galland ..... B26D 1/02 83/403
4,396,158 A * 8/1983 Olsen ..... B02C 4/08 241/2
4,511,586 A 4/1985 Fitzwater et al.
4,648,296 A * 3/1987 Wisdom ..... B26D 1/03 83/13
4,813,317 A * 3/1989 Urschel ..... B26D 1/36 83/356.3
4,945,794 A * 8/1990 Quo ..... B26D 1/03 83/13
4,972,888 A * 11/1990 Dean ..... B27L 11/005 144/172
5,694,824 A * 12/1997 Jacko ..... B26D 1/03 83/403
5,921,484 A * 7/1999 Smith ..... B02C 13/1828 241/275
6,536,691 B2 * 3/2003 Prewitt ..... A01J 27/04 241/101.01
6,895,846 B2 * 5/2005 Walker ..... B26D 1/02 83/403
6,928,915 B2 * 8/2005 Jensen ..... B26D 1/03 241/84
7,270,040 B2 * 9/2007 King ..... B26D 1/03 403/350
8,109,188 B2 * 2/2012 Bellmunt-Molins ..... B26D 1/0006 426/144
8,161,856 B2 * 4/2012 Jacko ..... B26D 1/03 83/403
9,517,572 B2 * 12/2016 Michel ..... B26D 7/0691
9,550,187 B2 * 1/2017 Dallimore ..... B02C 13/18
9,643,332 B2 * 5/2017 Bucks ..... B26D 1/36
9,675,089 B2 * 6/2017 Sammel ..... A22C 17/0033
9,855,668 B2 * 1/2018 Bucks ..... B26D 5/00
2002/0170991 A1 * 11/2002 Prewitt ..... A01J 27/04 241/89.3
2008/0022822 A1 * 1/2008 Jacko ..... B26D 1/03 83/403
2014/0007751 A1 1/2014 Michel et al.
2014/0083266 A1 3/2014 Bucks
2014/0230621 A1 * 8/2014 Bucks ..... B26D 1/36 83/403
2014/0290451 A1 10/2014 Jacko et al.
2017/0232630 A1 * 8/2017 Underwood ..... B26D 7/0691 83/44

OTHER PUBLICATIONS

European Search Report for European Patent Application No. EP 16 80 8496, dated Jan. 23, 2019, 8 pages.

* cited by examiner

MACHINES AND METHODS FOR CUTTING PRODUCTS

CROSS REFERENCE TO RELATED APPLICATIONS

This application claims the benefit of U.S. Provisional Application No. 62/174,985, filed Jun. 12, 2015, the contents of which are incorporated herein by reference.

BACKGROUND OF THE INVENTION

The present invention generally relates to methods and machines for cutting products. The invention particularly relates to machines equipped with a cutting head and an impeller adapted to rotate within the cutting head for transporting products to one or more knives mounted on the cutting head for cutting the products.

Various types of equipment are known for cutting (for example, slicing, shredding, granulating, etc.) food products, such as vegetable, fruit, dairy, and meat products. A widely used line of machines for this purpose is commercially available from Urschel Laboratories, Inc., under the name Urschel Model CC®, an embodiment of which is schematically represented in FIG. 1. The Model CC® machine line provides versions of centrifugal-type slicers capable of producing uniform slices, strip cuts, shreds, and granulations of a wide variety of products at high production capacities. When used to produce potato slices for potato chips, the Model CC® line of machines can make use of substantially round potatoes to produce a desirable circular chip shape with a minimum amount of scrap.

The Model CC® machine 10 represented in FIG. 1 includes a cutting head 12 mounted on a support ring 15 above a gear box 16. The cutting head 12 is generally annular-shaped with cutting knives (not shown) mounted at its inner circumference. An impeller 14 is coaxially mounted within the cutting head 12 and has an axis 17 of rotation that coincides with an axis of the cutting head 12. The impeller 14 rotates about its axis 17 within the cutting head 12, while the latter remains stationary. The impeller 14 is rotationally driven by a shaft that is enclosed within a housing 18 and coupled to the gear box 16. Products are delivered to the cutting head 12 and impeller 14 through a feed hopper 11 located above the cutting head 12. In operation, as the hopper 11 delivers products to the middle of the impeller 14, centrifugal forces cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates.

As a result of factors and constraints relating to product size, slicing speed, slice quality, weight, etc., present commercial embodiments of Model CC® machines have cutting heads with diameters of under fourteen inches (under 35 cm). Other aspects pertaining to the construction and operation of Model CC® machines, including improved embodiments thereof, are described in U.S. Pat. Nos. 5,694,824 and 6,968,765, the entire contents of which are incorporated herein by reference.

BRIEF DESCRIPTION OF THE INVENTION

The present invention provides methods and equipment suitable for cutting products.

According to one aspect of the invention, a machine is provided that includes a cutting head and an impeller. The cutting head has an annular shape that defines an axis of the cutting head and at least one knife that is oriented axially at an inner circumference of the cutting head and extends radially inward into an interior of the cutting head. The impeller is coaxially mounted within the interior of the cutting head so that an outer circumference thereof is adjacent the inner circumference of the cutting head. The impeller is mounted for rotation within the cutting head about the axis of the cutting head in a rotational direction relative to the cutting head. The impeller includes a base, a ring spaced axially from the base, an entrance to an interior of the impeller defined by the ring, and means for delivering products within the interior of the impeller toward the inner circumference of the cutting head as the impeller rotates within the cutting head. The impeller has outward radial directions that coincide with radials of the impeller that pass through the axis of the cutting head. The delivering means comprises paddles that are circumferentially spaced within the interior of the impeller between the base and the ring and are sized and configured for delivering and forcing food products in the outward radial directions toward the knife as the impeller rotates within the cutting head. The outer circumference of the impeller has a diameter of greater than 35 centimeters.

Other aspects of the invention include methods of using machines equipped with impellers and cutting heads of the types described above to cut products. Such a method includes rotating the impeller, supplying products to the impeller through the entrance defined by the ring, causing the products to be delivered toward the inner circumference of the cutting head through action of rotating the impeller, and slicing the products with one or more knives located at the inner circumference of the cutting head.

Other aspects and advantages of this invention will be better appreciated from the following detailed description.

DETAILED DESCRIPTION OF THE INVENTION

Figure 1:
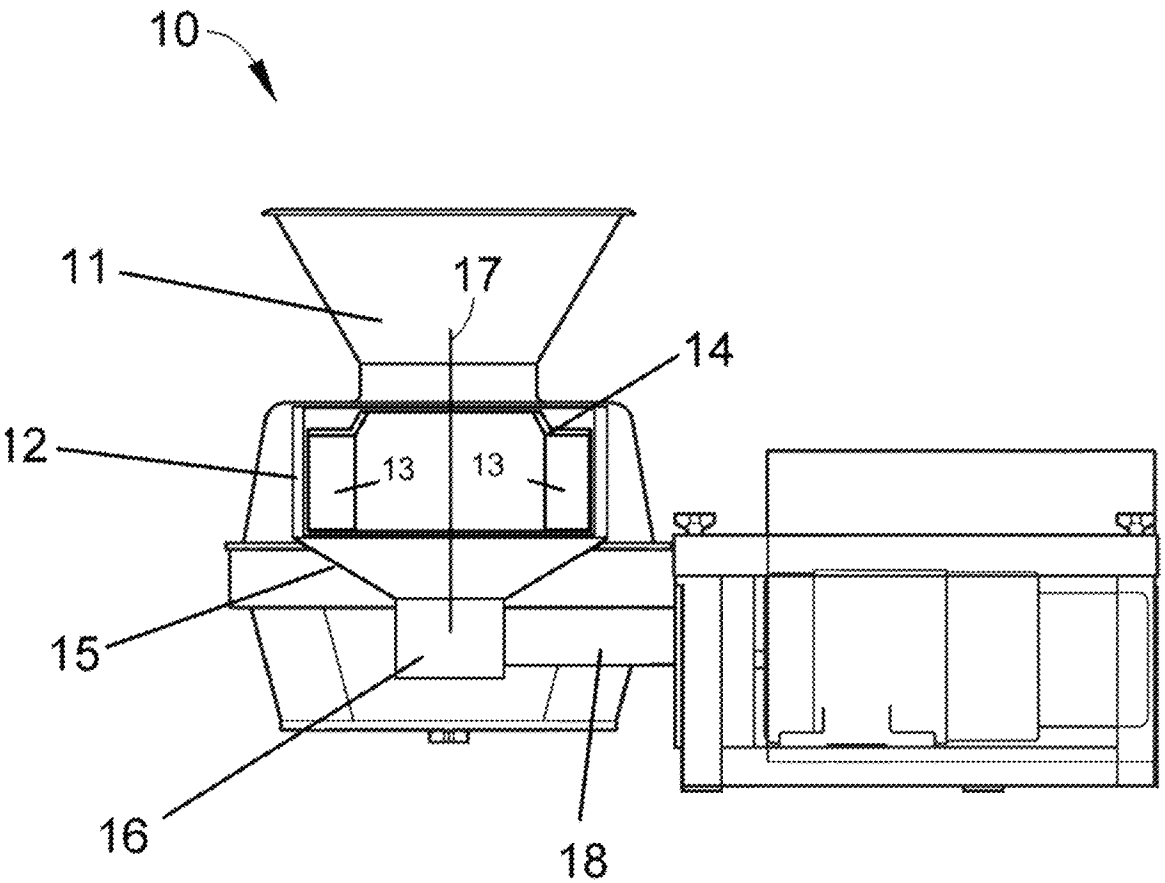
FIG. 1 PRIOR ART
FIG. 1 schematically represents a side view in partial cross-section of a cutting machine known in the art.
Figure 2:
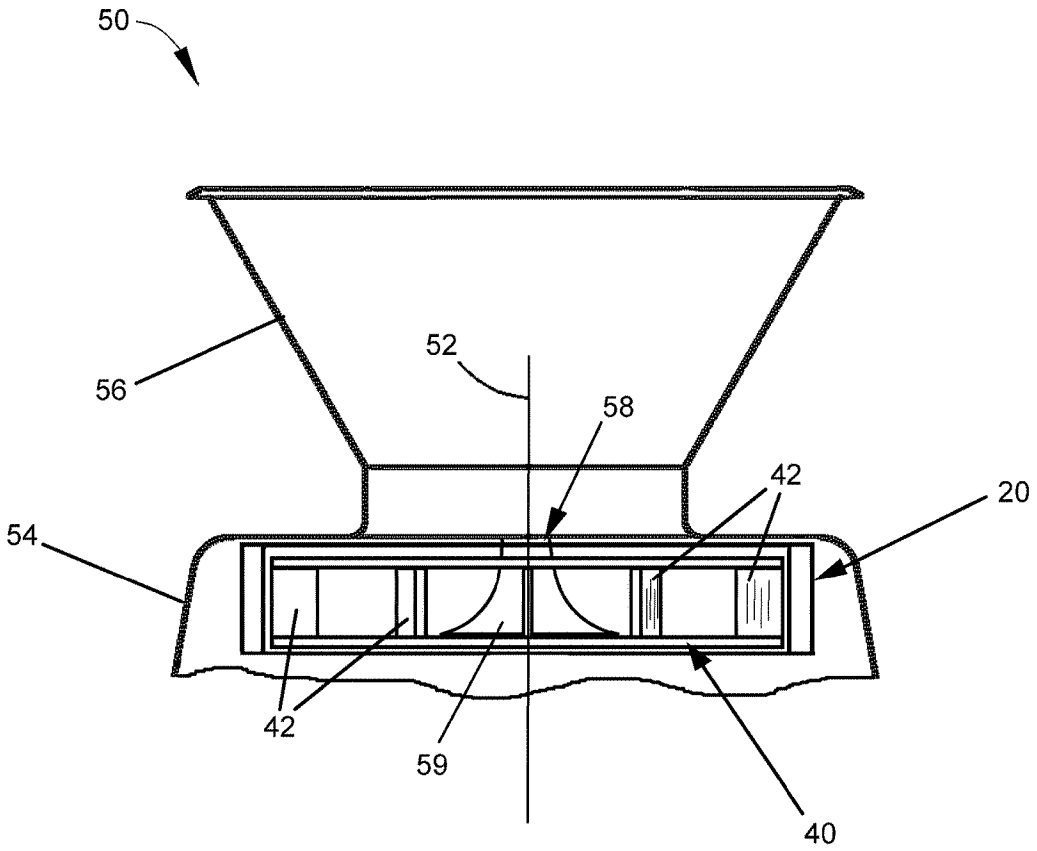
FIG. 2 schematically represents a cross-sectional view of a portion of a cutting machine in accordance with a non-limiting embodiment of the invention.
Figure 3:
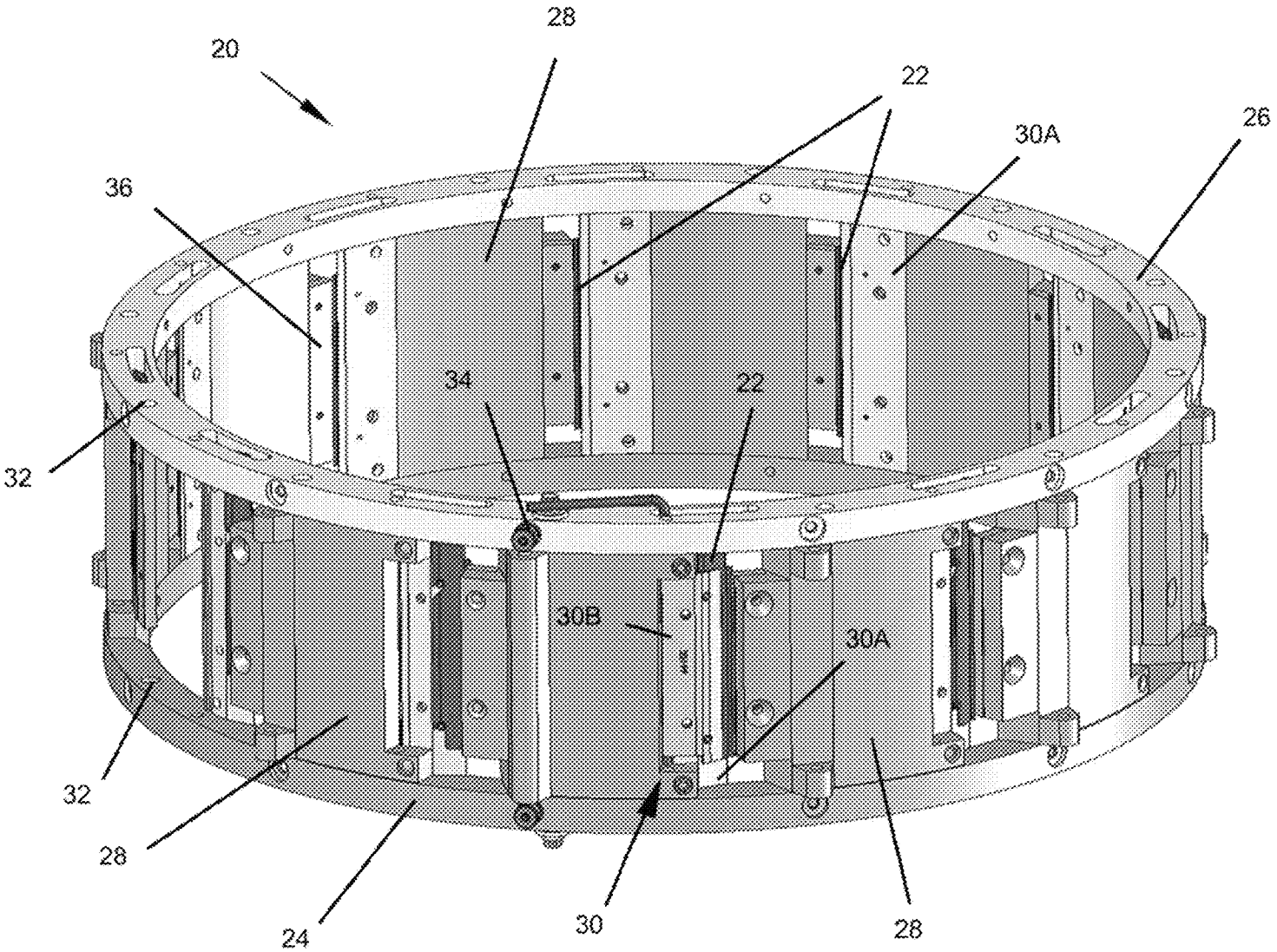
FIG. 3 is a perspective view representing a cutting head of a type suitable for use with the cutting machine of FIG. 2.
Figure 4:
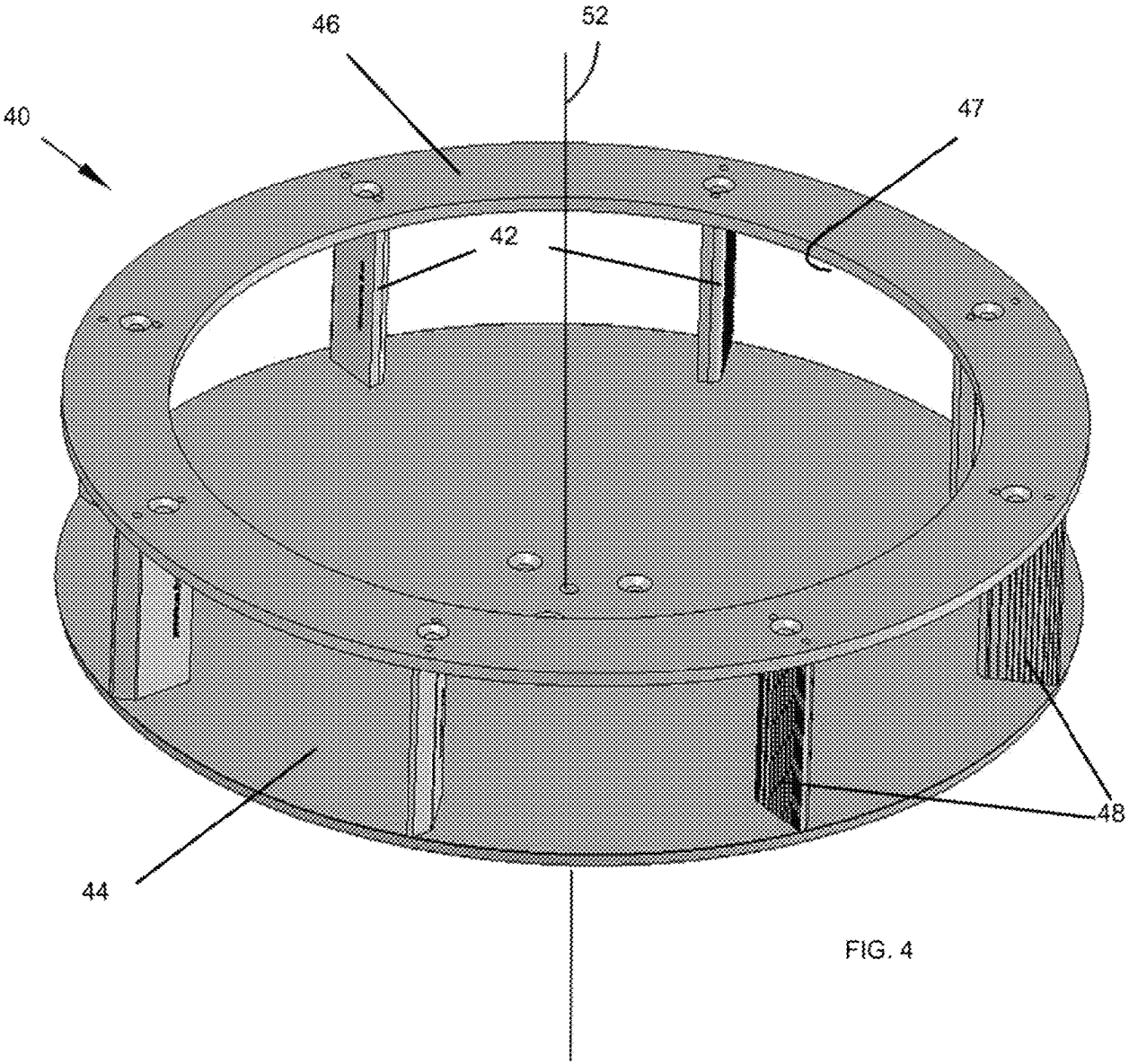
FIG. 4 is a perspective view representing an impeller of a type suitable for use with the cutting machine of FIG. 2 and the cutting head of FIG. 3.

FIG. 2 represents a nonlimiting example of a portion of a centrifugal-type cutting machine 50 similar to the Model CC® machine 10 of FIG. 1, though modified for reasons that will become apparent from the following discussion. FIGS. 3 and 4 represent, respectively, a cutting head 20 and an impeller 40 that, in accordance with nonlimiting embodiments of the present invention, are of types that can be used in the machine 50 of FIG. 2, which schematically represents the cutting head 20 and impeller 40 enclosed within a housing 54. Though the cutting head 20, impeller 40, and machine 50 will be discussed in reference to cutting food products, it should be understood that the scope of the invention encompasses the ability to cut other types of products.

Consistent with FIG. 1 and the discussion thereof, the cutting head 20 is generally annular-shaped with cutting knives 22 (FIG. 3) mounted and spaced about its perimeter. Also consistent with FIG. 1, the impeller 40 is adapted to be rotated within the cutting head 20 about an axis 52 of rotation, while the cutting head 20 remains stationary. The impeller 40 is represented in FIG. 2 as coaxially mounted within the cutting head 20 such that its axis 52 approximately coincides with an axis of the cutting head 20 and an outer circumference of the impeller 40 is adjacent an inner circumference of the cutting head 20. Based on the configurations of the machine 50, cutting head 20 and impeller 40 shown in FIGS. 2 through 4, the impeller 40 rotates clockwise within the cutting head 20 when viewed from above.

Each knife 22 of the cutting head 20 projects radially inward toward the interior of the cutting head 20, generally in a direction opposite the rotation of the impeller 40, and defines a cutting edge at its radially innermost extremity. The cutting head 20 of FIG. 3 comprises a lower support ring 24, an upper support ring 26, and circumferentially-spaced support segments (shoes) 28 (one of which is omitted in FIG. 3). The knives 22 of the cutting head 20 are individually secured to the shoes 28 with clamping assemblies 30. Each clamping assembly 30 includes a knife holder 30A mounted to the radially inward-facing side of a shoe 28, and a clamp 30B mounted on the radially outward-facing side of the shoe 28 to secure the knife 22 to the knife holder 30A (some clamp assemblies 30 are shown in FIG. 3 without their clamps 30B in order to expose their knives 22 and holders 30A). The clamping assemblies 30 enable the knives 22 to be replaced without removing the head 20 from its housing 54.

The shoes 28 are secured with bolts (not shown) or other suitable means to the support rings 24 and 26. The shoes 28 are equipped with coaxial pivot pins (not shown) that engage holes 32 (a pair of which is visible in FIG. 3) in the support rings 24 and 26. By pivoting on its pins, the orientation of a shoe 28 can be adjusted to alter the radial location of the cutting edge of its knife 22 with respect to the axis of the cutting head 20, thereby controlling the thickness of the sliced food product. As an example, adjustment can be achieved with an adjusting screw and/or pin 34 (one of which is shown in FIG. 3) located circumferentially behind the pivot pins. FIG. 3 further shows optional gate insert strips 36 mounted to each shoe 28, which the food product crosses prior to encountering the knife 22 mounted to the succeeding (trailing) shoe 28. Each gate insert strip 36 and its corresponding trailing knife 22 define a gate opening whose width can be adjusted by pivoting the shoe 28 toward and away from the cutting edge of the knife 22. As such, the thickness of each slice produced by a knife 22 is determined by the gate opening, and specifically the radial distance between the cutting edge of a knife 22 and the adjacent trailing edge of a gate insert strip 36 preceding the knife 22. As used herein, "trailing" refers to a position on a cutting head that follows or succeeds another in the direction of rotation of an impeller assembled with the cutting head, whereas "leading" refers to a position on a cutting head that is ahead of or precedes another in the direction opposite the impeller's rotation.

As represented in FIG. 4, the impeller 40 comprises generally radially-oriented paddles 42 disposed between a base 44 and an upper ring 46. The base 44 and ring 46 are represented in the embodiment of FIG. 4 as being parallel to each other and perpendicular to the rotational axis 52 of the impeller 40. The ring 46 defines an upper central opening 47 that provides an entrance through which food products enter an interior space of the impeller 40 defined by and between its base 44, ring 46, and outer circumference. In contrast, the base 44 is entirely closed to receive and support food products introduced into the impeller 40. The paddles 42 have clockwise-facing faces 48 that engage and direct the food products radially outward toward and against the knives 22 of the cutting head 20 as the impeller 40 rotates within the cutting head 20. The pitch of each paddle face 48 is preferably positive, meaning that the radially innermost extent of each paddle face 48 is angled toward the direction of rotation of the impeller 40 relative to a radial of the impeller 40. Alternatively, the pitch of the paddle faces 48 could be negative or neutral, the latter meaning that the face 48 of each paddle 42 entirely lies on a radial of the impeller 40.

The knives 22 shown in FIG. 3 are depicted as having straight cutting edges for producing flat slices, though other shapes could be used to produce sliced, strip-cut, shredded, or granulated products. For example, the knives 22 can have cutting edges that define a periodic pattern of peaks and valleys when viewed edgewise. The periodic pattern can be characterized by sharp peaks and valleys, or a more corrugated or sinusoidal shape characterized by more rounded peaks and valleys when viewed edgewise. If the peaks and valleys of each knife 22 are aligned with those of its leading knife 22, slices are produced in which each peak on one surface of a slice corresponds to a valley on the opposite surface of the slice, such that the slices are substantially uniform in thickness but have a cross-sectional shape that is characterized by sharp peaks and valleys ("V-slices") or a more corrugated or sinusoidal shape (crinkle slices), collectively referred to herein as periodic shapes. Alternatively, shredded food product can be produced if each peak of each knife 22 is aligned with a valley of its leading knife 22, and waffle/lattice-cut food product can be produced by intentionally making off-axis alignment cuts with a periodic-shaped knife, for example, by crosscutting a food product at two different angles, typically ninety degrees apart. In addition, strip-cut and granulated products can be produced with the use of additional knives and/or cutting wheels located downstream of the knives 22. Whether a sliced, strip-cut, shredded, granulated, or waffle/lattice-cut product is desired will depend on the desired shape or intended use of the product.

The embodiment represented in FIGS. 2 through 4 differs in part from current commercial embodiments of Model CC® machines in terms of the interior diameter of the cutting head 20 (defined by the inner circumference thereof) and the corresponding outer diameter of the impeller 40 (defined by the outer circumference thereof). In particular, the respective diameters of the cutting head 20 and impeller 40 exceed fourteen inches (about 35 cm), and preferably exceed twenty inches (about 50 cm). In a particular embodiment, the respective diameters of the cutting head 20 and impeller 40 are about twenty-one inches (about 53 cm), allowing for a suitable diametric clearance therebetween. Depending on the products being processed, the diameters of the cutting head 20 and impeller 40 will typically be capable of promoting greater throughput (higher capacity) in comparison to smaller commercial embodiments of Model CC® machines. The diameters of the cutting head 20 and impeller 40 also allow for the use of various alternative feeding methods that are not practical and may not be possible with smaller diameter cutting heads. For example, due to the larger diameters of the cutting head 20 and impeller 40, FIG. 2 represents the machine 50 as equipped with a feed hopper 56 configured with a feeding apparatus 58 that directs products downward and then radially outward toward the outer circumference of the impeller 40, rather than simply dropping the products in the center of the impeller 40 and entirely relying on centrifugal force to cause the products to move outward into engagement with the paddles 42 of the impeller 40 and, thereafter, the knives 22 of the cutting head 20. In the represented embodiment, the feeding apparatus 58 comprises an arcuately-tapering chute 59 that extends downward into the impeller 40 and redirects the products radially outward toward the outer circumference of the impeller 40 as the products enter the interior of the impeller 40. Alternatively, the paddles 42 of the impeller 40 could be replaced with tubes or a chute associated with a feeding apparatus that extends downward into the impeller 40 and is capable of orienting the products as they are delivered to the outer circumference of the impeller 40. In combination, the hopper 56, feeding apparatus 58, and paddles 42 can be considered to be members of a delivery means or unit of the machine 50.

FIG. 4 represents the face 48 of each paddle 42 as substantially planar with axially-oriented ribs or grooves that promote engagement and stability of the products during the cutting operation. In FIG. 4. the ribs/grooves are represented as being equi-spaced from each other, substantially parallel to each other, orientated substantially parallel to the axis 52 of the impeller 40, and continuous to an outward radial end of each paddle 42 at the outer circumference of the impeller 40. FIG. 4 further shows the ribs/grooves as occupying the entirety of each paddle face 48. It is within the scope that the ribs/grooves could be omitted or replaced with other surface features, including surface textures resulting from grit blasting the paddle faces 48. Suitable dimensions for the paddles 42 will depend in part on the size of the food products being processed, and therefore can vary considerably. In the embodiment of the impeller 40 represented in FIG. 4, each paddle 42 has a length between its radially innermost and outermost extents of less than twenty percent, roughly about fifteen percent, of the radius of the impeller 40, which is attributable at least in part to the relatively large diameter of the impeller 40. The number of paddles 42 within the impeller 40 can also be varied, i.e., more or less than the eight paddles 42 shown for the embodiment in FIG. 4.

While there are no restrictions on the height of the shoes 28 (i.e., in the axial direction of the cutting head 20), for practical reasons shoe height will typically be sized to accommodate the size of the product being cut but limited so as not to unnecessarily add unnecessary weight to the cutting head 20. The circumferential lengths and spacing of the shoes 28 preferably enable the food product to settle when being cut and between cutting operations performed by a pair of circumferentially successive shoes 28, and to ensure that the food product isn't being cut by two knives 22 at the same time. For this reason, the cutting head 20 is shown in FIG. 3 as comprising twelve shoes 28 to which are mounted a corresponding number of knives 22. The eight paddles 42 of the impeller 40 depicted in FIG. 4 are believed to be effective in conjunction with the twelve knives 22 of the cutting head 20 depicted in FIG. 3. Similar to the shoes 28 of the cutting head 20, while there are no restrictions on the height of the paddles 42 (i.e., in the axial direction of the impeller 40), for practical reasons paddles 42 are preferably sized so that the axial height of the impeller 40 is less than the axial height of the cutting head 20, corresponding to the representation of the machine 50 in FIG. 2.

Due to the relatively large diameter of the cutting head 20, the head 20 will have a correspondingly low rake-off angle, such that slices leaving the knives 22 will tend to be relatively flat with reduced likelihood of cracking attributable to bending as the slices are coming off the knives 22. As used herein, the term "rake-off angle" is measured as the angle that a slice must deviate relative to a tangent line that begins at an intersection defined by the knife edge and a path of a product sliding surface defined by the interior surface of a leading shoe 28, i.e., the shoe 28 immediately upstream of a particular knife 22. The line is then tangent to the radial product sliding surface of the leading shoe 28. The rake-off angle is a function of both the hardware and the gap setting at which the entire knife holder 30A, knife 22, and shoe 28 is positioned. In commercial embodiments of Model CC® machines, a typical rake-off angle is about 29 to 30 degrees, whereas the larger diameter cutting head 20 of FIG. 3 may have a typical rake-off angle that is lower by 2 to 4 degrees or more, for example, a rake-off angle of 26 to 27 degrees, with lower angles also being foreseeable. By reducing the rake-off angle, potential benefits include further increases in slice quality, reduced liquid (juice) losses, reduced starch release, fewer fines, etc.

Also due to the larger diameter of the impeller 40, it is foreseeable that the higher rotational speeds for the impeller 40 may be attained and adjusted to obtain an appropriate tip speed (velocity at the outer extremities of the paddles 42) to maintain or further promote slice quality.

In combination, the cutting head 20 and impeller 40 are well suited for producing slices of a wide variety of products, including food products such as vegetables, cheese, nuts, etc. The cutting head 20 and impeller 40 are capable of offering improvements and versatility for producing slices, strip cuts, shreds and granulations from a wider variety of products at high production capacities. The cutting head 20 and impeller 40 are also well suited for processing food products that are relatively large, for example, larger than potatoes of sizes commonly used to produce potato chips (e.g., larger than diameters of about two to three inches).

While the invention has been described in terms of specific embodiments, it is apparent that other forms could be adopted by one skilled in the art. For example, the impeller 40, cutting head 20, and machine 50 in which they are installed could differ in appearance and construction from the embodiments shown in the drawings, the functions of each component of the impeller 40, cutting head 20, and machine 50 could be performed by components of different construction but capable of a similar (though not necessarily equivalent) function, and various materials and processes could be used to fabricate the impeller 40, cutting head 20, machine 50, and their components. In addition, the nonlimiting embodiment of the cutting head 20 shown in FIG. 3 is particularly adapted to cut food products into slices, though it is foreseeable that the impeller 40 could be used in combination with a cutting head adapted for cutting other materials. Therefore, the scope of the invention is to be limited only by the following claims.

The invention claimed is:

1. A machine for cutting products, the machine comprising:

a cutting head having an annular shape that defines an axis of the cutting head, and at least one knife oriented axially at an inner circumference of the cutting head, the knife extending radially inward into an interior of the cutting head;

an impeller coaxially mounted within the interior of the cutting head so that the impeller has a rotational axis that coincides with the axis of the cutting head and has an outer circumference adjacent the inner circumference of the cutting head, the impeller being mounted for rotation within the cutting head about the axis of the cutting head in a rotational direction relative to the cutting head, the impeller comprising a base, a ring spaced axially from the base, an entrance to an interior of the impeller defined by the ring, and delivering means for delivering products within the interior of the impeller toward the inner circumference of the cutting head as the impeller rotates within the cutting head, the impeller having outward radial directions that coincide with radials of the impeller that pass through the axis of the cutting head, the delivering means comprising paddles that are circumferentially spaced within the interior of the impeller between the base and the ring and are sized and configured for delivering and forcing the products in the outward radial directions toward the at least one knife as the impeller rotates within the cutting head, the outer circumference of the impeller having a diameter of greater than 35 centimeters;

a housing enclosing the cutting head and the impeller; and a feed hopper fixedly attached to the housing and a feeding apparatus fixed attached to the feed hopper to direct the products downward and then redirect the products radially outward toward the outer circumference of the impeller, the feeding apparatus comprising a chute that has a longitudinal axis that is coaxial with the rotational axis of the impeller, extends downward from the feed hopper, extends into the impeller through the entrance thereof and toward the base thereof, has a lowermost extent that is adjacent to the base of the impeller, and has an upper surface that defines a curved profile along the longitudinal axis of the chute from an upper end of the chute to the lowermost extent of the chute so that the chute is arcuately tapered from the upper end thereof to the lowermost extent thereof and the chute increases in diameter toward the base, the chute being configured so that the products traveling downward into the interior of the impeller are redirected radially outward by the upper surface of the chute toward the outer circumference of the impeller as the products enter the interior of the impeller.

2. The machine of claim 1, wherein the impeller has a diameter of greater than fifty centimeters.

3. The machine of claim 1, wherein the cutting head has at least twelve knives oriented axially at the inner circumference of the cutting head.

4. The machine of claim 1, wherein the impeller has at least eight paddles.

5. The machine of claim 1, wherein each of the paddles extends to the outer circumference of the impeller at an angle relative to a corresponding one of the radials of the impeller intersecting the paddle.

6. The machine of claim 1, wherein each of the paddles as a length between radially innermost and radially outermost extents thereof of less than 20 percent of a radius of the impeller.

7. The machine of claim 1, wherein the delivering means comprises grooves defined on faces of the paddles that face the rotational direction of the impeller.

8. The machine of claim 7, wherein the grooves on each paddle are equi-spaced, substantially parallel to each other, orientated substantially parallel to the axis of the impeller, and continuous to an outward radial end of the paddle at the outer circumference of the impeller.

9. A method of using the machine of claim 1, the method comprising:

rotating the impeller;

supplying products to the impeller with the feed hopper and the chute through the entrance defined by the ring, the upper surface of the chute redirecting the products traveling downward into the interior of the impeller radially outward toward the outer circumference of the impeller as the products enter the interior of the impeller;

causing the products to be delivered toward the inner circumference of the cutting head through action of rotating the impeller; and slicing the products with the knife.

10. The method of claim 9, wherein the products are food products.

11. The method of claim 9, wherein the products have diameters greater than three inches.

* * * * *